US011982444B2

(12) United States Patent
Liu et al.

(10) Patent No.: US 11,982,444 B2
(45) Date of Patent: May 14, 2024

(54) SYSTEM FOR DISPOSING HIGH-MOISTURE MIXED WASTE COMPOSED OF KITCHEN GARBAGE AND WATER-CONTAINING SLUDGE

(71) Applicants: GUANGDONG UNIVERSITY OF TECHNOLOGY, Guangzhou (CN); Guangzhou Herui Energy Conservation and Environmental Protection Technology Co., Ltd., Guangzhou (CN)

(72) Inventors: Xiaozhou Liu, Guangzhou (CN); Peibin Lin, Guangzhou (CN); Guangyu Zhu, Guangzhou (CN); Wei Liu, Guangzhou (CN); Yu Zhang, Guangzhou (CN)

(73) Assignees: GUANGDONG UNIVERSITY OF TECHNOLOGY, Guangzhou (CN); Guangzhou Herui Energy Conservation and Environmental Protection Technology Co., Ltd., Guangzhou (CN)

( * ) Notice: Subject to any disclaimer, the term of this patent is extended or adjusted under 35 U.S.C. 154(b) by 415 days.

(21) Appl. No.: 17/463,623

(22) Filed: Sep. 1, 2021

(65) Prior Publication Data

US 2022/0146094 A1 May 12, 2022

Related U.S. Application Data

(63) Continuation of application No. PCT/CN2020/131582, filed on Dec. 29, 2020.

(51) Int. Cl.
*F23G 5/04* (2006.01)
*F23G 5/12* (2006.01)
(Continued)

(52) U.S. Cl.
CPC ..... *F23G 5/04* (2013.01); *F23G 5/12* (2013.01); *F23G 5/442* (2013.01); *F23G 5/46* (2013.01);
(Continued)

(58) Field of Classification Search
CPC ... F23G 5/04; F23G 5/12; F23G 5/442; F23G 5/46; F23G 7/001; F23G 2201/10;
(Continued)

(56) References Cited

U.S. PATENT DOCUMENTS 2,057,681 A * 10/1936 Harrington ..... F23G 5/004 34/502
2,116,573 A * 5/1938 Harrington ..... F23G 5/004 110/228
(Continued)

FOREIGN PATENT DOCUMENTS

CN 102607040 A 7/2012
CN 102607041 A 7/2012
(Continued)

OTHER PUBLICATIONS

Internation Search Report of PCT/CN2020/131582, Mailed Aug. 5, 2021.

*Primary Examiner* — David J Laux

(57) ABSTRACT

A system for disposing a high-moisture mixed waste composed of kitchen garbage and water-containing sludge is provided, including a mixed waste storage device, a mixed waste primary-drying device and a mixed waste incinerating device. The mixed waste primary-drying device includes a mixed waste primary-drying body, a primary-drying material inlet, a primary-dried material outlet, a drying gas inlet and a primary waste gas outlet. A discharging outlet of the mixed waste storage device is connected with the primary-drying material inlet through the first conveying belt. The mixed waste incinerating device includes an incinerator, an
(Continued)

incineration material inlet, an incineration material outlet, a combustion-supporting gas inlet and a flue gas outlet. The incineration material inlet is connected with the primary-dried material outlet through the second conveying belt and the combustion-supporting gas inlet is connected with the primary waste gas outlet. The flue gas outlet is connected with the drying gas inlet.

16 Claims, 3 Drawing Sheets

(51) Int. Cl.
*F23G 5/44* (2006.01)
*F23G 5/46* (2006.01)
*F23G 7/00* (2006.01)

(52) U.S. Cl.
CPC ..... *F23G 7/001* (2013.01); *F23G 2201/10* (2013.01); *F23G 2201/20* (2013.01); *F23G 2205/122* (2013.01); *F23G 2206/10* (2013.01)

(58) Field of Classification Search
CPC ..... F23G 2201/20; F23G 2205/122; F23G 2206/10; F26B 2200/04; F26B 3/10; F26B 5/04; F26B 23/028
See application file for complete search history.

(56) References Cited

U.S. PATENT DOCUMENTS

| | | | | |
|---|---|---|---|---|
| 2,286,309 | A * | 6/1942 | Rowen | F23G 5/28 110/225 |
| 2,744,477 | A * | 5/1956 | Hartley | F23G 5/28 432/131 |
| 4,215,637 | A * | 8/1980 | Lombana | F23G 5/38 110/225 |
| 5,263,266 | A * | 11/1993 | Schmidt | F26B 3/00 34/79 |
| 6,311,906 | B1 * | 11/2001 | Kim | C08J 11/00 34/384 |
| 6,715,431 | B1 * | 4/2004 | Maejima | F23G 5/38 110/211 |
| 8,276,289 | B2 | 10/2012 | Causer | |
| 10,247,049 | B2 * | 4/2019 | Janicki | F23G 5/40 |
| 2012/0111715 | A1 * | 5/2012 | Krois | F26B 23/10 201/14 |
| 2012/0145051 | A1 | 6/2012 | Sweeney | |
| 2014/0013783 | A1 * | 1/2014 | Xiang | C02F 1/048 62/122 |
| 2022/0003410 | A1 * | 1/2022 | Carvalho | B65G 69/20 |

FOREIGN PATENT DOCUMENTS

| | | | |
|---|---|---|---|
| CN | 110513704 | A | 11/2019 |
| CN | 111250508 | A | 6/2020 |
| CN | 111895415 | A | 11/2020 |
| JP | 2000130718 | A | 5/2000 |

* cited by examiner

SYSTEM FOR DISPOSING HIGH-MOISTURE MIXED WASTE COMPOSED OF KITCHEN GARBAGE AND WATER-CONTAINING SLUDGE

CROSS-REFERENCE TO RELATED APPLICATIONS

This application is a continuation of International Patent Application No. PCT/CN2020/131582 with a filing date of Dec. 29, 2020, designating the United States, now pending, and further claims priority to Chinese Patent Application No. 202011242001.9 with a filing date of Nov. 9, 2020. The content of the aforementioned applications, including any intervening amendments thereto, are incorporated herein by reference.

TECHNICAL FIELD

The present invention relates to the field of garbage disposal, and more particularly, to a system for disposing a high-moisture mixed waste composed of kitchen garbage and water-containing sludge.

BACKGROUND

With the continuous increase of population, the acceleration of urbanization and the improvement of living standards, the amount of municipal garbage has been increased rapidly in recent years. There are three main ways for disposing the municipal garbage in China harmlessly: landfill, incineration and composting. Domestic garbage in China is mainly disposed by the landfill, and proportions of the incineration and the composting are small, but the proportion of the incineration is increased every year. Compared with the landfill, the incineration has the advantages of capacity reduction, amount reduction and energy reuse. If the landfill is mainly used continuously, more cities will be surrounded by garbage in the near future, which forces China to accelerate the construction of garbage incineration plants.

Kitchen garbage and sludge garbage involved in municipal domestic garbage both contain a large amount of moisture. Therefore, the garbage must undergo drying and dewatering during incinerating. When removing the moisture, not only a large amount of heat is needed to dry the garbage, but also waste gas generated after drying needs to be properly disposed before being discharged into the atmosphere, so as to avoid secondary pollution to the environment.

In addition, energy consumption is needed during incineration of high-moisture garbage, thus having a high garbage disposal cost. When garbage is incinerated in a garbage incinerator at a relatively low temperature, a lot of ash is generated, and coking is easy to occur on the walls of the garbage incinerator, which affects the service life and the incineration efficiency of the garbage incinerator.

Therefore, it has become an urgent problem to provide a system for disposing a high-moisture mixed waste composed of kitchen garbage and water-containing sludge, which can effectively remove moisture in garbage, and is pollution-free and energy-saving.

SUMMARY

The present invention aims to overcome the defects of existing technologies above, and provides a system for disposing a high-moisture mixed waste composed of kitchen garbage and water-containing sludge, which can effectively remove moisture in garbage, and makes full use of heat produced by garbage incineration to implement energy circulation and environmental protection.

In order to achieve the above objective, the present invention provides a system for disposing a high-moisture mixed waste composed of kitchen garbage and water-containing sludge, which includes a mixed waste storage device, a mixed waste primary-drying device and a mixed waste incinerating device which are connected in sequence, wherein the mixed waste primary-drying device includes a mixed waste primary-drying body, and a primary-drying material inlet, a primary-drying material outlet, a drying gas inlet and a primary waste gas outlet which are arranged on the mixed waste primary-drying body, and a discharging outlet of the mixed waste storage device is connected with the primary-drying material inlet of the mixed waste primary-drying device through the first conveying belt; and the mixed waste incinerating device includes an incinerator, and an incineration material inlet, an incineration material outlet, a combustion-supporting gas inlet and a flue gas outlet which are arranged on the incinerator, the combustion-supporting gas inlet is connected with the primary waste gas outlet of the mixed waste primary-drying device, and the flue gas outlet is connected with the drying gas inlet of the mixed waste primary-drying device.

Preferably, a fan is arranged at the primary waste gas outlet of the mixed waste primary-drying device to blow waste gas into the mixed waste incinerating device.

Preferably, a mixed waste secondary-drying device is also arranged between the mixed waste primary-drying device and the mixed waste incinerating device, the mixed waste secondary-drying device includes a mixed waste secondary-drying body, and a secondary-drying material inlet, a secondary-drying material outlet, a drying gas inlet, a drying gas outlet and a secondary waste gas outlet which are arranged on the mixed waste secondary-drying body, wherein the secondary-drying material inlet is connected with the primary-drying material outlet of the mixed waste primary-drying device through a conveying device, the secondary-drying material outlet is connected with the incineration material inlet of the mixed waste incinerating device through the second conveying belt, the drying gas inlet is connected with the flue gas outlet of the mixed waste incinerating device, and the drying gas outlet and the secondary waste gas outlet are respectively connected with the combustion-supporting gas inlet of the mixed waste incinerating device.

Preferably, the conveying device includes a grab bucket and a cross beam, after being dried by the mixed waste primary-drying device, the mixed waste passes through the cross beam by the grab bucket and then is conveyed to the mixed waste secondary-drying device by the grab bucket, and then the grab bucket passes through the cross beam to return to the mixed waste primary-drying device to continue grabbing the mixed waste.

Preferably, a waste gas vacuum pump is arranged at the secondary waste gas outlet to suck the waste gas into the mixed waste incinerating device.

Optionally, a vacuum drying device is arranged between the mixed waste secondary-drying device and the mixed waste incinerating device, a material inlet of the vacuum drying device is connected with the secondary dried material outlet of the mixed waste secondary-drying device, a material outlet of the vacuum drying device is connected with the incineration inlet of the mixed waste incinerating device, and a steam outlet of the vacuum drying device is connected with the combustion-supporting gas inlet of the mixed waste incinerating device through a vacuum pump.

Optionally, garbage with a moisture content of 80% to 90% from the mixed waste storage device is conveyed to the mixed waste primary-drying device through the first conveying belt for drying to have a moisture content of 40% to 50%, and then is conveyed to the mixed waste secondary-drying device through the conveying device for drying to have a moisture content of 20% to 25%, then the moisture content of the mixed waste is reduced to below 10% through the vacuum drying device, then the mixed waste is conveyed to the mixed waste incinerating device through the second conveying belt for incineration, and exhaust flue gas is conveyed back to the mixed waste primary-drying device and the mixed waste secondary-drying device to dry the garbage.

Optionally, a mixer is arranged at the combustion-supporting gas inlet of the mixed waste incinerating device, the inlet of the mixer is connected with the primary waste gas outlet of the mixed waste primary-drying device, the secondary waste gas outlet of the mixed waste secondary-drying device and the drying gas outlet of the mixed waste secondary-drying device, and the outlet of the mixer is connected with the combustion-supporting gas inlet of the mixed waste incinerating device.

Preferably, a fan is arranged at the outlet of the mixer to blow combustion-supporting gas into the combustion-supporting gas inlet of the mixed waste incinerating device.

Optionally, a heat exchanger is arranged at the flue gas outlet of the mixed waste incinerating device, the heat exchanger includes a heat exchanger body, and a cold air inlet, a hot air outlet, a high-temperature flue gas inlet and a medium-temperature flue gas outlet which are arranged on the heat exchanger body, the cold air inlet is connected with a fan, the hot air outlet is connected with the inlet of the mixer, the high-temperature flue gas inlet is connected with the flue gas outlet of the mixed waste incinerating device, and the medium-temperature flue gas outlet is connected with the drying gas inlet of the mixed waste primary-drying device and the drying gas inlet of the mixed waste secondary-drying device through the first flue gas pipeline.

Preferably, the first flue gas pipeline is provided with a first flue gas fan and a first flue gas valve to control the flow rate of medium-temperature flue gas into the mixed waste primary-drying device and the mixed waste secondary-drying device.

Preferably, the medium-temperature flue gas outlet is also connected with a chimney through the second flue gas pipeline, and the second flue gas pipeline is provided with a second flue gas valve and a second flue gas fan.

Optionally, air at 20° C. to 25° C. from the atmosphere absorbs heat from flue gas at 350° C. to 360° C. produced by the mixed waste incinerating device through the heat exchanger to form hot air at 250° C. to 260° C., and then the hot air is conveyed to the mixer to support combustion of the mixed waste incinerating device, thus improving a combustion efficiency of the mixed waste, and flue gas at 240° C. to 250° C. generated after heat exchange is conveyed back to the mixed waste primary-drying device and the mixed waste secondary-drying device to dry the garbage.

Optionally, the drying gas inlet of the mixed waste primary-drying device is arranged at a bottom end of the mixed waste primary-drying body, the primary waste gas outlet is arranged at a top end of the mixed waste primary-drying body, the primary-drying material inlet is arranged above one side of the mixed waste primary-drying body, and the primary-drying material outlet is arranged above the other side of the mixed waste primary-drying body.

Optionally, a bottom plate is arranged at the lower part of the interior of the mixed waste primary-drying body to divide an inner cavity of the mixed waste primary-drying body into a garbage drying area at an upper portion and a gas circulating area at a lower portion, a plurality of evenly distributed through holes are installed in the bottom plate, each through hole is provided with an upwardly convex cone-shaped air cap, and a plurality of air holes are made in a peripheral wall of each air cap, so that drying gas coming from the drying gas inlet enters the garbage drying area from each air hole to preliminarily dry the garbage.

Optionally, the mixed waste secondary-drying device is a vacuum dryer, the secondary drying material inlet is arranged in the center of the top end of the mixed waste secondary-drying body, the secondary drying material outlet is arranged in the center of the bottom end of the mixed waste secondary-drying body, the drying gas inlet is arranged on one side of the bottom end of the mixed waste secondary-drying body, the drying gas outlet is arranged on one side of the top end of the mixed waste secondary-drying body, the secondary waste gas outlet is arranged above one side of the mixed waste secondary-drying body, a plurality of air inlet pipes are annularly arranged on the inner walls of the mixed waste secondary-drying body, adjacent air inlet pipes are connected end to end, the air inlet pipe with an unconnected tail end is connected with the drying gas inlet, and the air inlet pipe with an unconnected top end is connected with the drying gas outlet.

Optionally, a supplementary combustion device is also arranged between the drying gas inlet of the mixed waste primary-drying device and the medium-temperature flue gas outlet of the heat exchange device, the supplementary combustion device includes a supplementary combustion body, and a first gas inlet, a second gas inlet and a combustion gas outlet which are installed on the supplementary combustion body, the first gas inlet is connected with a methane gas source, the second gas inlet is connected with the medium-temperature flue gas outlet of the heat exchange device, and the combustion gas outlet is connected with the drying gas inlet of the mixed waste primary-drying device.

Optionally, combustion gas at 270° C. to 280° C. produced by combustion of the supplementary combustion device is conveyed to the mixed waste primary-drying device to dry the garbage.

Optionally, a moisture content of the mixed waste is greater than or equal to 80%, and the mixed waste is a mixture of kitchen garbage and domestic sludge in a weight ratio of 1:1 to 3:1.

Compared with the prior art, the present invention has the advantages and beneficial effects that: (1) the waste gas produced by drying the moisture in the garbage is incinerated together with the dried garbage, so that the garbage is thoroughly disposed, and the garbage odor is prevented from being leaked to pollute the environment; (2) waste heat recycle is fully implemented on heat of the flue gas generated by incinerating the garbage, thus effectively reducing energy consumption and recycling energy; (3) three levels of garbage drying and incineration devices with different structures are used, which are suitable for drying garbage with different moisture contents, with a low operation cost and simple operation and management; (4) the cold air is heated into the hot air through the heat exchanger, which increases the incineration temperature of the mixed waste incinerating device, and generated ash reduces the occurrence of coking on the walls of the incinerator, thus improving the service life and the incineration efficiency of the mixed waste incinerating device, reducing nitrogen oxides generated during garbage incineration at the same time, and reducing output of pollutants; and (5) the supplementary combustion device can further increase the drying temperature of the mixed waste primary-drying device and improve a garbage drying efficiency.

DETAILED DESCRIPTION

Figure 1:
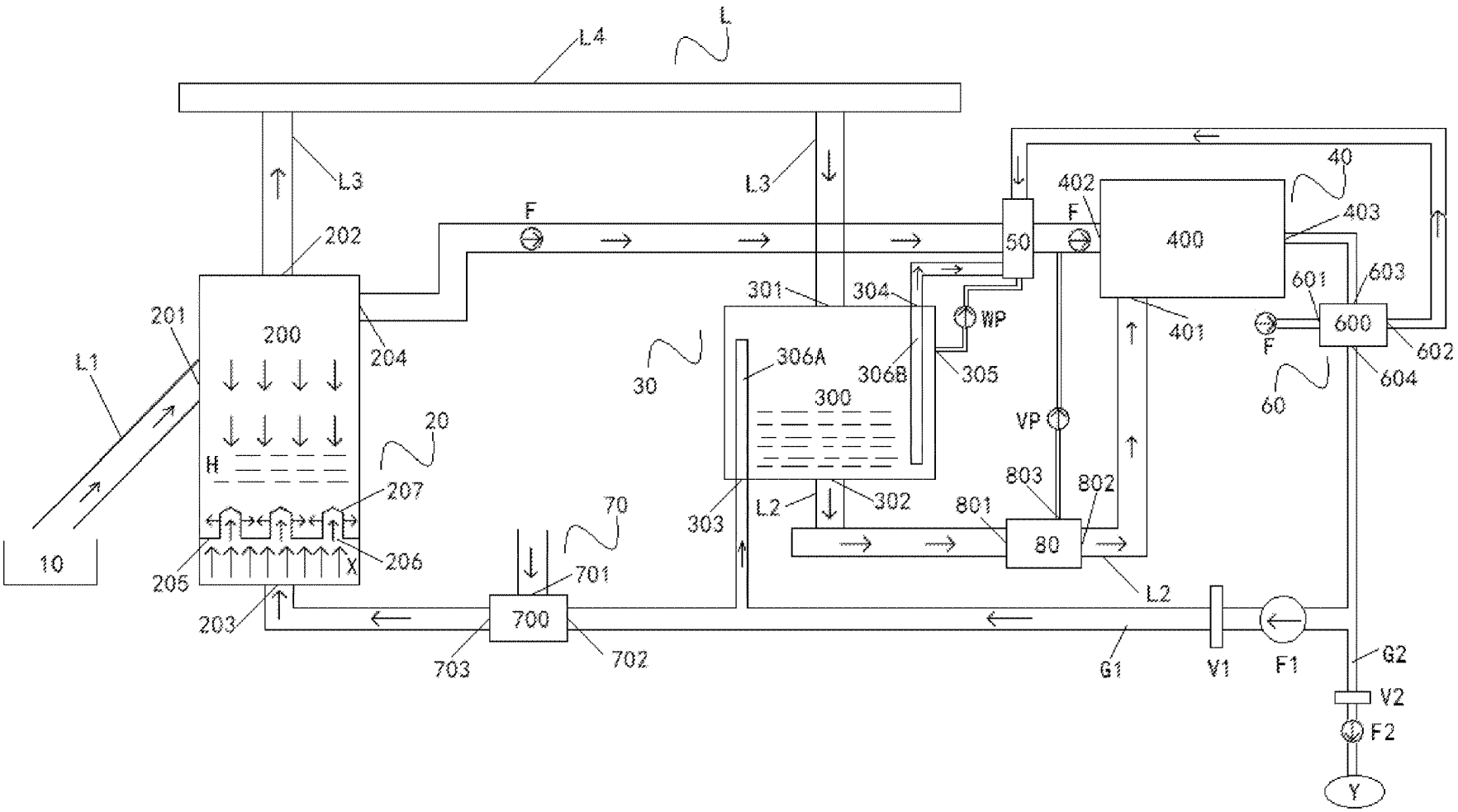
FIG. 1 is a schematic diagram of a structure of a system for disposing a high-moisture mixed waste composed of kitchen garbage and water-containing sludge of the present invention.

The embodiments of the present invention will be described in detail hereinafter. Examples of the embodiments are shown in the accompanying drawings. The same or similar reference numerals throughout the drawings denote the same or similar elements or elements having the same or similar functions. The embodiments described hereinafter with reference to the accompanying drawings are exemplary and are intended to explain the present invention, but shall not be understood as limiting the present invention.

With reference to FIG. 1, as a non-limiting embodiment, a system for disposing a high-moisture mixed waste provided by the present invention includes a mixed waste storage device 10, a mixed waste primary-drying device 20, a mixed waste secondary-drying device 30, a mixed waste incinerating device 40 and a vacuum drying device 80.

The mixed waste storage device 10 stores a mixed waste with a moisture content of 80% to 90%, such as a mixture of kitchen garbage and domestic sludge, which is conveyed to the mixed waste primary-drying device 20 through the first conveying belt L1.

The mixed waste primary-drying device 20 includes a mixed waste primary-drying body 200, a primary-drying material inlet 201, a primary-drying material outlet 202, a drying gas inlet 203 and a primary waste gas outlet 204.

The mixed waste secondary-drying device 30 includes a mixed waste secondary-drying body 300, a secondary-drying material inlet 301, a secondary-drying material outlet 302, a drying gas inlet 303, a drying gas outlet 304 and a secondary waste gas outlet 305.

The mixed waste incinerating device 40 includes an incinerator 400, an incineration material inlet 401, an incineration material outlet (not shown in the drawings), a combustion-supporting gas inlet 402 and a flue gas outlet 403.

The vacuum drying device 80 includes a material inlet 801, a material outlet 802 and a steam outlet 803.

The secondary drying material inlet 301 of the mixed waste secondary-drying device 30 is connected with the primary drying material outlet 202 of the mixed waste primary-drying device 20 through a conveying device L. The material inlet 801 of the vacuum drying device 80 is connected with the secondary drying material outlet 302 of the mixed waste secondary-drying device 30, the material outlet 802 of the vacuum drying device 80 is connected with the incineration material inlet 401 of the mixed waste incinerating device 40 through the second conveying belt L2, and the steam outlet 803 of the vacuum drying device 80 is connected with the combustion-supporting gas inlet 402 of the mixed waste incinerating device 40 through a vacuum pump VP.

In the non-limiting embodiment, a vacuum pressure of the vacuum drying device 80 is 0.005 Mpa, a multi-level high-efficiency vacuum pump is used as the vacuum drying device 80, and the vacuum pressure is reduced to 0.005 Mpa, which is far lower than the pressure corresponding to the boiling point temperature of water contained in mixed waste in the mixed waste secondary-drying device 30. Therefore, moisture in a mixed waste may be further rapidly evaporated without heating, so that the moisture content of the mixed waste can be reduced to below 10%.

The combustion-supporting gas inlet 402 of the mixed waste incinerating device 40 is connected with the primary waste gas outlet 204 of the mixed waste primary-drying device 20 as well as the drying gas outlet 304 and the secondary waste gas outlet 305 of the mixed waste secondary-drying device 30, and the flue gas outlet 403 of the mixed waste incinerating device 40 is connected with the drying gas inlet 203 of the mixed waste primary-drying device 20 and the drying gas inlet 303 of the mixed waste secondary-drying device 30. In order to implement directional flow of gas, a fan F is arranged at the primary waste gas outlet 204, and a waste gas vacuum pump WP is arranged at the secondary waste gas outlet 305, thus achieving an effect of leading waste gas into the mixed waste incinerating device 40.

In the non-limiting embodiment, the conveying device L includes a grab bucket L3 and a cross beam L4. Therefore, a mixed waste with a moisture content of 80% to 90% from the mixed waste storage device 10 is conveyed to the mixed waste primary-drying device 20 through the first conveying belt L for drying to have a moisture content of 40% to 50%, then the mixed waste passes through the cross beam L4 by the grab bucket L3 and then is conveyed to the mixed waste secondary-drying device 30 by the grab bucket L3, and then the grab bucket L3 passes through the cross beam L4 to return to the mixed waste primary-drying device 20 to continue grabbing primary-drying garbage with a moisture content of 40% to 50%. The primary dried garbage with the moisture content of 40% to 50% is dried in the mixed waste secondary-drying device 30 to have a moisture content of 20% to 25%, and then is dried again through the vacuum drying device 80, so that the moisture content of the mixed waste is reduced to below 10%. Then, the mixed waste is conveyed to the mixed waste incinerating device 40 through the second conveying belt L2 for incineration, and the generated flue gas is conveyed back to the mixed waste primary-drying device 20 and the mixed waste secondary-drying device 30 to dry the garbage.

As another non-limiting embodiment, a mixer 50 is arranged at the combustion-supporting gas inlet 402 of the mixed waste incinerating device 40, the inlet (not shown in the drawings) of the mixer 50 is connected with the primary waste gas outlet 204 of the mixed waste primary-drying device 20 as well as the drying gas outlet 304 and the secondary waste gas outlet 305 of the mixed waste secondary-drying device 30, and the outlet (not shown in the drawings) of the mixer 50 is connected with the combustion-supporting gas inlet 402 of the mixed waste incinerating device 40. Similarly, a fan F is arranged at the outlet of the mixer 50 to lead combustion-supporting gas into the combustion-supporting gas inlet 402 of the mixed waste incinerating device 40.

In the non-limiting embodiment, a heat exchanger 60 is arranged at the flue gas outlet 403 of the mixed waste incinerating device 40, which includes a heat exchanger body 600, a cold air inlet 601, a hot air outlet 602, a high-temperature flue gas inlet 603 and a medium-temperature flue gas outlet 604. The cold air inlet 601 is connected with a fan F, the hot air outlet 602 is connected with the inlet (not shown in the drawings) of the mixer 50, the high-temperature flue gas inlet 603 is connected with the flue gas outlet 403 of the mixed waste incinerating device 40, and the medium-temperature flue gas outlet 604 is connected with the drying gas inlet 203 of the mixed waste primary-drying device 20 and the drying gas inlet 303 of the mixed waste secondary-drying device 30. The amount of hot air from the hot air outlet 602 of the heat exchanger 60 is set to account for 30% to 50% of the total air supply of the combustion-supporting gas inlet 402 of the mixed waste incinerating device 40, for example, the amount of hot air may be set to about 35% of the total air supply, so that high-temperature and low-oxygen combustion will be realized in the mixed waste incinerating device 40.

As shown in FIG. 1, the medium-temperature flue gas outlet 604 is connected with the drying gas inlet 203 of the mixed waste primary-drying device 20 and the drying gas inlet 303 of the mixed waste secondary-drying device 30 through a first flue gas pipeline G1, and the first flue gas pipeline G1 is provided with a first flue gas fan F1 and a first flue gas valve V1. The medium-temperature flue gas outlet 604 is also connected with a chimney Y through a second flue gas pipeline G2, and the second flue gas pipeline G2 is provided with a second flue gas valve V2 and a second flue gas fan F2, so that the flow and speed of medium-temperature flue gas entering the mixed waste primary-drying device 20 and the mixed waste secondary-drying device 30 may be controlled. When a large amount of medium-temperature flue gas is not needed, the flue gas may be discharged to the chimney Y.

Therefore, air at 20° C. to 25° C. from the atmosphere exchanges heat with flue gas at 350° C. to 360° C. generated by the mixed waste incinerating device 40 through the heat exchanger 60 to form hot air at 250° C. to 260° C., and then the hot air is conveyed to the mixer 50 to support combustion of the mixed waste incinerating device, thus improving a combustion efficiency of the garbage, and also ensuring a temperature stability in the incinerator, and flue gas at 240° C. to 250° C. generated after heat exchange is conveyed back to the mixed waste primary-drying device 20 and the mixed waste secondary-drying device 30 to dry the garbage.

Figure 2:
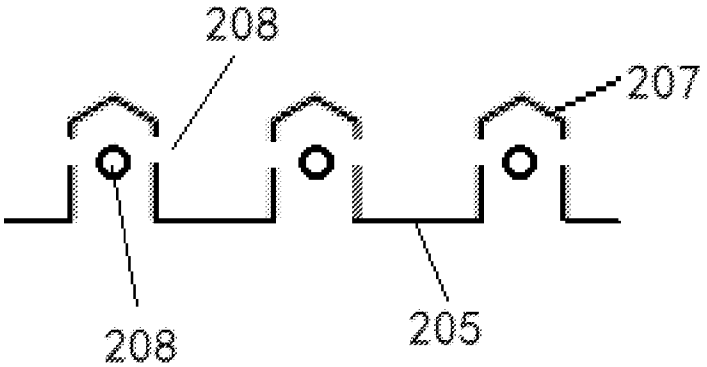
FIG. 2 is a schematic diagram of a cross-section of an air cap of a mixed waste primary-drying device of the present invention.

In yet another non-limiting embodiment, as shown in FIG. 1, the primary-drying material inlet 201 of the mixed waste primary-drying device 20 is arranged above one side of the mixed waste primary-drying body 200, and the primary waste gas outlet 204 is arranged above the other side of the mixed waste primary-drying body 200. The drying gas inlet 203 is arranged at a bottom end of the mixed waste primary-drying body 200, and the primary drying material outlet 202 is arranged at a top end of the mixed waste primary-drying body 200. A bottom plate 205 is arranged at the lower part of the interior of the mixed waste primary-drying body 200 to divide the inner cavity of the mixed waste primary-drying body into a garbage drying area H at an upper portion and a gas circulating area X at a lower portion. The bottom plate 205 is provided with a plurality of evenly distributed through holes 206, and each through hole 206 is provided with an upwardly convex cone-shaped air cap 207. As shown in FIG. 2, a plurality of air holes 208 are made in a peripheral wall of each air cap 207, so that drying gas may enter the garbage drying area H from each air hole 208 to preliminarily dry the garbage.

Figure 3:
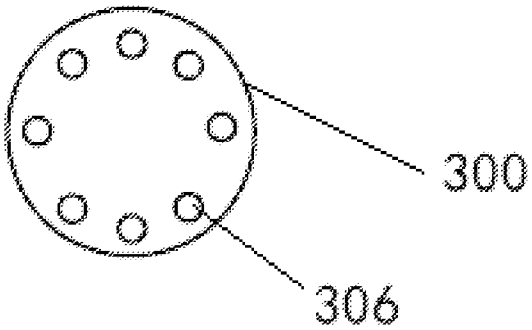
FIG. 3 is a schematic diagram of a cross-section structure of a mixed waste secondary-drying device of the present invention.

In the non-limiting embodiment, as shown in FIG. 1, the mixed waste secondary-drying device 30 is a vacuum dryer with a vacuum pressure of 0.02 Mpa. The secondary dried material inlet 301 is arranged in the center of the top end of the mixed waste secondary-drying body 300, the secondary drying material outlet 302 is arranged in the center of the bottom end of the mixed waste secondary-drying body 300, the drying gas inlet 303 is arranged on one side of the bottom end of the mixed waste secondary-drying body 300, the drying gas outlet 304 is arranged on one side of the top end of the mixed waste secondary-drying body 300, and the secondary waste gas outlet 305 is arranged above one side of the mixed waste secondary-drying body 300. A plurality of air inlet pipes 306 (as shown in FIG. 3) are annularly arranged on the inner walls of the mixed waste secondary-drying body 300, adjacent air inlet pipes are connected end to end to form an annular structure similar to a radiator set with a tail end outlet and a top end outlet at two ends respectively, the air inlet pipe 306A with an unconnected tail end (provided with the tail end outlet) is connected with the drying gas inlet 303, and the air inlet pipe 306B with an unconnected top end (provided with the top end outlet) is connected with the drying gas outlet 304.

As yet another non-limiting embodiment, as shown in FIG. 1, a supplementary combustion device 70 is also arranged between the drying gas inlet 203 of the mixed waste primary-drying device 20 and the medium-temperature flue gas outlet 604 of the heat exchange device 60. The supplementary combustion device 70 includes a supplementary combustion body 700, a first gas inlet 701, a second gas inlet 702 and a combustion gas outlet 703. The first gas inlet 701 is connected with a methane gas source, the second gas inlet 702 is connected with the medium-temperature flue gas outlet 604 of the heat exchange device 60, and the combustion gas outlet 703 is connected with the drying gas inlet 203 of the mixed waste primary-drying device 20. Therefore, flue gas at 270° C. to 280° C. produced by the supplementary combustion device may be conveyed to the mixed waste primary-drying device 20 to dry the garbage.

Although the embodiments of the present invention have been shown and described above, it can be understood that the above embodiments are exemplary and cannot be understood as limiting the present invention, and those of ordinary skills in the art may make changes, modifications, substitutions and variations to the above embodiments within the scope of the present invention.

What is claimed is:

1. A system for disposing a high-moisture mixed waste composed of kitchen garbage and water-containing sludge, comprising a mixed waste storage device, a mixed waste primary-drying device and a mixed waste incinerating device which are connected in sequence, the mixed waste primary-drying device comprising a mixed waste primary-drying body, and a primary-drying material inlet, a primary-dried material outlet, a drying gas inlet and a primary waste gas outlet which are arranged on the mixed waste primary-drying body, and a discharging outlet of the mixed waste storage device being connected with the primary-drying material inlet of the mixed waste primary-drying device through the first conveying belt; and the mixed waste incinerating device comprising an incinerator, and an incineration material inlet, an incineration material outlet, a combustion-supporting gas inlet and a flue gas outlet which are arranged on the incinerator, the combustion-supporting gas inlet being connected with the primary waste gas outlet of the mixed waste primary-drying device, and the flue gas outlet being connected with the drying gas inlet of the mixed waste primary-drying device;

wherein a mixed waste secondary-drying device is also arranged between the mixed waste primary-drying device and the mixed waste incinerating device, the mixed waste secondary-drying device comprises a mixed waste secondary-drying body, and a secondary-drying material inlet, a secondary-dried material outlet, a drying gas inlet, a drying gas outlet and a secondary waste gas outlet which are arranged on the mixed waste secondary-drying body, the secondary dried material inlet is connected with the primary dried material outlet of the mixed waste primary-drying device through a conveying device, the secondary dried material outlet is connected with the incineration material inlet of the mixed waste incinerating device through the second conveying belt, the drying gas inlet is connected with the flue gas outlet of the mixed waste incinerating device, and the drying gas outlet and the secondary waste gas outlet are respectively connected with the combustion-supporting gas inlet of the mixed waste incinerating device;

wherein a vacuum drying device is arranged between the mixed waste secondary-drying device and the mixed waste incinerating device, the material inlet of the vacuum drying device is connected with the secondary dried material outlet of the mixed waste secondary-drying device, a material outlet of the vacuum drying device is connected with the incineration material inlet of the mixed waste incinerating device, and the steam outlet of the vacuum drying device is connected with the combustion-supporting gas inlet of the mixed waste incinerating device through a vacuum pump.

2. The system for disposing the high-moisture mixed waste composed of kitchen garbage and water-containing sludge according to claim 1, wherein a mixer is arranged at the combustion-supporting gas inlet of the mixed waste incinerating device, the inlet of the mixer is connected with the primary waste gas outlet of the mixed waste primary-drying device, the secondary waste gas outlet of the mixed waste secondary-drying device and the drying gas outlet of the mixed waste secondary-drying device, and the outlet of the mixer is connected with the combustion-supporting gas inlet of the mixed waste incinerating device.

3. The system for disposing the high-moisture mixed waste composed of kitchen garbage and water-containing sludge according to claim 2, wherein a heat exchanger is arranged at the flue gas outlet of the mixed waste incinerating device, the heat exchanger comprises a heat exchanger body, and a cold air inlet, a hot air outlet, a high-temperature flue gas inlet and a medium-temperature flue gas outlet which are arranged on the heat exchanger body, the cold air inlet is connected with a fan, the hot air outlet is connected with the inlet of the mixer, the high-temperature flue gas inlet is connected with the flue gas outlet of the mixed waste incinerating device, and the medium-temperature flue gas outlet is connected with the drying gas inlet of the mixed waste primary-drying device and the drying gas inlet of the mixed waste secondary-drying device through the first flue gas pipeline.

4. The system for disposing the high-moisture mixed waste composed of kitchen garbage and water-containing sludge according to claim 3, wherein air at 20° C. to 25° C. from the atmosphere absorbs heat from flue gas at 350° C. to 360° C. generated by the mixed waste incinerating device through the heat exchanger to form hot air at 250° C. to 260° C., and then the hot air is conveyed to the mixer to support combustion of the mixed waste incinerating device, and flue gas at 240° C. to 250° C. generated after heat exchange is conveyed back to the mixed waste primary-drying device and the mixed waste secondary-drying device to dry the garbage.

5. The system for disposing the high-moisture mixed waste composed of kitchen garbage and water-containing sludge according to claim 4, wherein a bottom plate is arranged in the lower part of the interior of the mixed waste primary-drying body to divide the inner cavity of the mixed waste primary-drying body into a garbage drying area at the upper portion and a gas circulating area at the lower portion, a plurality of evenly distributed through holes are installed in the bottom plate, each through hole is provided with an upwardly convex cone-shaped air cap, and a plurality of air holes are made in a peripheral wall of each air cap, so that drying gas coming from the drying gas inlet enters the garbage drying area from each air hole to preliminarily dry the garbage.

6. The system for disposing the high-moisture mixed waste composed of kitchen garbage and water-containing sludge according to claim 5, wherein the mixed waste secondary-drying device is a vacuum dryer, the secondary-drying material inlet is arranged in the center of the top end of the mixed waste secondary-drying body, the secondary dried material outlet is arranged in the center of the bottom end of the mixed waste secondary-drying body, the drying gas inlet is arranged on one side of the bottom end of the mixed waste secondary-drying body, the dry gas outlet is arranged on one side of the top end of the mixed waste secondary-drying body, the secondary waste gas outlet is arranged above one side of the mixed waste secondary-drying body, a plurality of air inlet pipes are annularly arranged on an inner wall of the mixed waste secondary-drying body, adjacent air inlet pipes are connected end to end, the air inlet pipe with an unconnected tail end is connected with the drying gas inlet, and the air inlet pipe with an unconnected top end is connected with the dry gas outlet.

7. The system for disposing the high-moisture mixed waste composed of kitchen garbage and water-containing sludge according to claim 6, wherein a supplementary combustion device is also arranged between the drying gas inlet of the mixed waste primary-drying device and the medium-temperature flue gas outlet of the heat exchange device, the supplementary combustion device comprises a supplementary combustion device body, and the first gas inlet, the second gas inlet and a combustion gas outlet which are arranged on the supplementary combustion device body, the first gas inlet is connected with a methane gas source, the second gas inlet is connected with the medium-temperature flue gas outlet of the heat exchange device, and the combustion gas outlet is connected with the drying gas inlet of the mixed waste primary-drying device.

8. The system for disposing the high-moisture mixed waste composed of kitchen garbage and water-containing sludge according to claim 7, wherein combustion gas at 270° C. to 280° C. generated by burner of the supplementary combustion device is conveyed to the mixed waste primary-drying device to dry the garbage.

9. The system for disposing the high-moisture mixed waste composed of kitchen garbage and water-containing sludge according to claim 2, wherein a moisture content of the mixed waste is greater than or equal to 80%, and the mixed waste is a mixture of kitchen garbage and domestic sludge in a weight ratio of 1:1 to 3:1.

10. The system for disposing the high-moisture mixed waste composed of kitchen garbage and water-containing sludge according to claim 3, wherein a moisture content of the mixed waste is greater than or equal to 80%, and the mixed waste is a mixture of kitchen garbage and domestic sludge in a weight ratio of 1:1 to 3:1.

11. The system for disposing the high-moisture mixed waste composed of kitchen garbage and water-containing sludge according to claim 4, wherein a moisture content of the mixed waste is greater than or equal to 80%, and the mixed waste is a mixture of kitchen garbage and domestic sludge in a weight ratio of 1:1 to 3:1.

12. The system for disposing the high-moisture mixed waste composed of kitchen garbage and water-containing sludge according to claim 5, wherein a moisture content of the mixed waste is greater than or equal to 80%, and the mixed waste is a mixture of kitchen garbage and domestic sludge in a weight ratio of 1:1 to 3:1.

13. The system for disposing the high-moisture mixed waste composed of kitchen garbage and water-containing sludge according to claim 6, wherein a moisture content of the mixed waste is greater than or equal to 80%, and the mixed waste is a mixture of kitchen garbage and domestic sludge in a weight ratio of 1:1 to 3:1.

14. The system for disposing the high-moisture mixed waste composed of kitchen garbage and water-containing sludge according to claim 7, wherein a moisture content of the mixed waste is greater than or equal to 80%, and the mixed waste is a mixture of kitchen garbage and domestic sludge in a weight ratio of 1:1 to 3:1.

15. The system for disposing the high-moisture mixed waste composed of kitchen garbage and water-containing sludge according to claim 8, wherein a moisture content of the mixed waste is greater than or equal to 80%, and the mixed waste is a mixture of kitchen garbage and domestic sludge in a weight ratio of 1:1 to 3:1.

16. The system for disposing the high-moisture mixed waste composed of kitchen garbage and water-containing sludge according to claim 1, wherein the moisture content of the mixed waste is greater than or equal to 80%, and the mixed waste is a mixture of kitchen garbage and domestic sludge in a weight ratio of 1:1 to 3:1.

* * * * *